US008100507B2

(12) United States Patent
Edwards et al.

(10) Patent No.: US 8,100,507 B2
(45) Date of Patent: Jan. 24, 2012

(54) INDUSTRIAL INK JET PRINTER

(75) Inventors: Paul Andrew Edwards, Ypsilanti, MI (US); John Hennessy, Grosse Pointe Park, MI (US)

(73) Assignee: Electronics For Imaging, Inc., Foster City, CA (US)

( * ) Notice: Subject to any disclaimer, the term of this patent is extended or adjusted under 35 U.S.C. 154(b) by 768 days.

(21) Appl. No.: 11/862,613

(22) Filed: Sep. 27, 2007

(65) Prior Publication Data

US 2008/0074469 A1 Mar. 27, 2008

Related U.S. Application Data

(60) Provisional application No. 60/847,567, filed on Sep. 27, 2006.

(51) Int. Cl.
*B41J 2/14* (2006.01)

(52) U.S. Cl. ..... 347/49

(58) Field of Classification Search ..... None
See application file for complete search history.

(56) References Cited

U.S. PATENT DOCUMENTS

| | | | | | |
|---|---|---|---|---|---|
| 3,869,986 | A | | 3/1975 | Hubbard | |
| 4,230,902 | A | * | 10/1980 | Hug et al. | 178/15 |
| 4,465,800 | A | | 8/1984 | Bhatia | |
| 4,493,252 | A | | 1/1985 | Clark | |
| 4,803,119 | A | | 2/1989 | Duff et al. | |
| 5,067,832 | A | * | 11/1991 | Baur et al. | 400/66 |
| 5,104,448 | A | | 4/1992 | Kruse | |
| 5,154,761 | A | | 10/1992 | Cooke et al. | |
| 5,160,535 | A | | 11/1992 | Cooke et al. | |
| 5,309,176 | A | * | 5/1994 | Faes et al. | 347/220 |
| 5,376,169 | A | | 12/1994 | Hotomi et al. | |
| 5,393,331 | A | | 2/1995 | Loria et al. | |
| 5,443,628 | A | | 8/1995 | Loria et al. | |
| 5,467,973 | A | | 11/1995 | Graushar et al. | |
| 5,510,415 | A | | 4/1996 | Zahrobsky et al. | |
| 5,565,143 | A | | 10/1996 | Chan | |
| 5,616,540 | A | | 4/1997 | Lithgow et al. | |
| 5,630,363 | A | | 5/1997 | Davis et al. | |
| 5,725,985 | A | | 3/1998 | Nealey et al. | |
| 5,739,833 | A | | 4/1998 | Yamazaki et al. | |
| 5,760,818 | A | * | 6/1998 | Hinton et al. | 347/263 |
| 5,847,743 | A | * | 12/1998 | Look | 347/176 |
| 5,985,079 | A | | 11/1999 | Ellison | |
| 6,019,046 | A | | 2/2000 | Rodi et al. | |
| 6,048,914 | A | | 4/2000 | Goto et al. | |
| 6,113,679 | A | | 9/2000 | Adkins et al. | |
| 6,126,281 | A | | 10/2000 | Shimoda et al. | |
| 6,231,654 | B1 | | 5/2001 | Elwakil | |
| 6,254,218 | B1 | | 7/2001 | Suzuki et al. | |
| 6,276,273 | B1 | | 8/2001 | Aurenty et al. | |

(Continued)

FOREIGN PATENT DOCUMENTS

| | | |
|---|---|---|
| DE | 10051088 | 4/2002 |

(Continued)

*Primary Examiner* — Julian Huffman
*Assistant Examiner* — Alexander C Witkowski
(74) *Attorney, Agent, or Firm* — Michael A. Glenn; Glenn Patent Group

(57) ABSTRACT

A printer comprising a base module having a main drive element and a print zone, a main module back plane coupled with the base module, a machine base rail system coupled to the base module, and an expansion module releasably coupled to the machine base rail system between an operating position and a removed position.

12 Claims, 1 Drawing Sheet

U.S. PATENT DOCUMENTS

Figure 1:
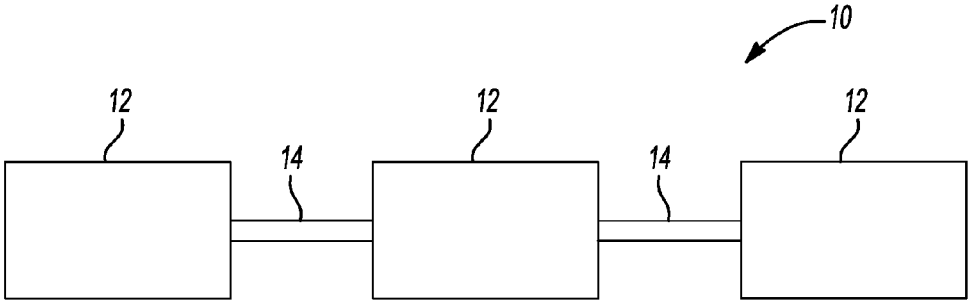

| | | | |
|---|---|---|---|
| 6,328,418 | B1 | 12/2001 | Yamada et al. |
| 6,346,353 | B1 | 2/2002 | Wang et al. |
| 6,413,590 | B1 | 7/2002 | Anderson et al. |
| 6,443,568 | B1 | 9/2002 | Askeland et al. |
| 6,455,136 | B1 | 9/2002 | Okajima et al. |
| 6,523,949 | B1 | 2/2003 | Ewert |
| 6,530,645 | B2 | 3/2003 | Haflinger |
| 6,533,379 | B1 | 3/2003 | Kubota et al. |
| 6,575,558 | B1 | 6/2003 | Grose et al. |
| 6,585,369 | B1 | 7/2003 | Sievert et al. |
| 6,588,889 | B2 | 7/2003 | Jeanmaire |
| 2001/0007464 | A1 | 7/2001 | Kellett |
| 2002/0029723 | A1 | 3/2002 | Fox et al. |
| 2002/0109738 | A1 | 8/2002 | Ozawa |
| 2002/0183419 | A1 | 12/2002 | Lin et al. |
| 2003/0081061 | A1 | 5/2003 | Gunther et al. |
| 2003/0143346 | A1 | 7/2003 | Yoshizawa et al. |
| 2003/0214554 | A1 | 11/2003 | Tschida |
| 2003/0218663 | A1 | 11/2003 | Baxter et al. |
| 2003/0224150 | A1 | 12/2003 | Ludwig et al. |
| 2004/0080595 | A1 | 4/2004 | Taguchi et al. |
| 2004/0121173 | A1 | 6/2004 | St. Arnauld |
| 2004/0179062 | A1 | 9/2004 | Rai et al. |
| 2004/0201661 | A1 | 10/2004 | Li |
| 2005/0129879 | A1 | 6/2005 | Bodis |
| 2005/0189066 | A1 | 9/2005 | Look et al. |
| 2006/0092221 | A1 | 5/2006 | Jeong |

FOREIGN PATENT DOCUMENTS

| | | | |
|---|---|---|---|
| EP | 0628956 | | 12/1994 |
| EP | 963854 | A2 | 12/1999 |
| EP | 1293344 | | 3/2003 |
| EP | 1308491 | | 5/2003 |
| EP | 1367101 | A1 | 12/2003 |
| JP | 9-71040 | A | 3/1997 |
| JP | 2004/034675 | | 2/2004 |
| WO | WO-01/45957 | | 6/2001 |
| WO | WO-02/055619 | A1 | 7/2002 |
| WO | WO-02/006294 | | 8/2002 |
| WO | WO-02/062894 | A1 | 8/2002 |
| WO | WO-2004/022353 | | 3/2004 |
| WO | WO-2004/043702 | | 5/2004 |

* cited by examiner

INDUSTRIAL INK JET PRINTER

CROSS-REFERENCE TO RELATED APPLICATIONS

This application claims the benefit of U.S. Provisional Application No. 60/847,567 filed on Sep. 27, 2006. The disclosure of the above application is incorporated herein by reference.

FIELD

The present disclosure relates to ink jet printers and, more particularly, relates to industrial ink jet printers having a modular construction.

BACKGROUND

The statements in this section merely provide background information related to the present disclosure and may not constitute prior art.

Industrial ink jet printing systems are designed to serve users with specific and varied requirements. Some users may only need a relatively simple configuration consisting of an unwind, print zone, ink curing zone and a rewind spindle, while other users would also require a web cleaner, web pretreatment zone, a web guide, additional curing zones or many other application specific modules. In addition, digital printing system design must make use of highly accurate backplane surfaces to which the web transport elements (drive rollers, idlers, dancer rolls, etc) and print hardware are mounted to. In order to meet the highly varied needs of all users in the marketplace, it is necessary to create many custom printing systems, each one special, highly engineered and not cost effective enough to wider markets.

As an alternative, one very large system could be designed that had space for all possible configurations, features and options. This approach would reduce the engineering effort, and standardize the design and construction. However, it would force all users to purchase a machine that is potentially much larger and more expensive than they need, again not cost effective. From an engineering standpoint, it would also necessitate a very large back plane, which is more difficult to keep in a true plane, resulting in negative performance characteristics.

Previous work in digital press design revolved around custom printer design specific to a user, or a design lacking the options or features that users need. Digital printing systems lack the ability to cost effectively add or change features and options for their varied users.

SUMMARY

The present teachings are superior to methods previously used because it uses a modular approach to digital printer system design. The design comprises a base module containing the main drive elements and print zone, common on all print systems. This module is made up of the main module back plane, and a machine base "rail system" which would allow additional modules to be added before or after the base module. The rail system is expandable and provide for easy drop in and bolt up add on modules. Add on modules are designed for unwinding substrates, web cleaning, corona treating, static control, pre-treatment, coating, curing, graphic printing, additional curing, laminating, die cutting, waste removal, serial number printing, sheeting, rewind, or any other feature or further process that the digital market required.

This approach standardizes the designs significantly, allows for easy expansion of features, maintains appropriate cost profiles in that users pay for the modules they need, and not for modules or features they do not. It also allows changes to be made in the field, as user's needs changes or expand. Finally, from an engineering standpoint, smaller backplanes are easier and more cost effective to manufacture. Additionally, when a design change is necessary, it would affect only the design of that module, and would not affect the entire printer system.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 2:
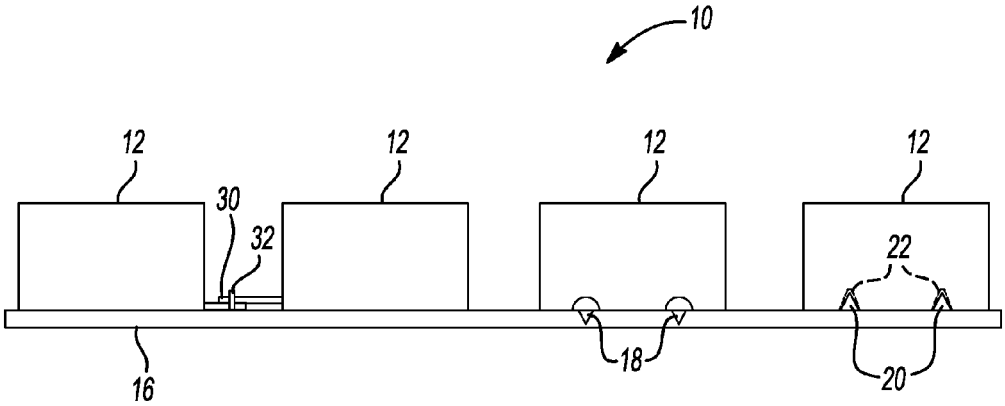

FIG. 1 is a schematic view illustrating a modular ink jet printer system according to some embodiments of the present teachings; and FIG. 2 is a schematic view illustrating a modular ink jet printer system according to additional embodiments of the present teachings.

DETAILED DESCRIPTION

The following description is merely exemplary in nature and is not intended to limit the present disclosure, application, or uses.

The present teachings use a modular approach to designing and building digital printers for industrial use. According to these teachings, print modules are designed for specific purposes and added to the expandable base support. The base support can consist of a main backplane or backplanes and a rail system that can be expanded to accept removable modules at various positions along the base support. In those embodiments using a rail system, the rail system provides basic support and alignment for modules 12, both during initial build and during field modifications. Options and features can be organized logically, placed into the rail system, aligned and affixed in place using standard fasteners and fastening methods. One or more printing functions are designed into a module depending on the characteristics required. Examples may include a module that handles the unwind spindle and tension dancer functions, a module that handles web cleaning and corona treatment and modules that include specific UV lamps from outside vendors. If a change to a configuration is needed, or a new capability is desired, the existing modules can conveniently be loosened and slid down or removed to make room for the new module. With this expandable rail system, feature upgrades can be done with minimal effort.

With particular reference to the figures, a modular ink jet printer system 10 is provided having a plurality of modular components or modules 12. Each of the plurality of modules 12 can be either stand alone modules that are arranged inline and optionally mounted together with tie bars 14 (FIG. 1), or can be smaller subsections that are attached to a main framework or base support 16 (FIG. 2).

With reference to FIG. 1, each of the plurality of modules 12 can be coupled to tie bars 14 via conventional fasteners or coupling devices (not shown). However, it should be understood that tie bars 14 can be used to properly and accurately position each of the plurality of modules 12 related to adjacent modules 12 to achieve a reliable and accurate printing and/or processing methodology. Therefore, in some embodiments, tie bars 14 can be manufactured to a tolerance sufficient to achieve this desired module-to-module spacing. During operation, individual modules 12 of modular ink jet printer system 10 can be removed and replaced to achieve a modified printer operation.

With reference to FIG. 2, in some embodiments, each of the plurality of modules 12 can be coupled to base support 16 via conventional fasteners or coupling devices 18. In this regard, base support 16, being a single integral member, provides a consistent mounting structure having unchanging predetermined mounting locations. These mounting locations receive each of the plurality of modules 12 and are arranged such that they define a relative position between adjacent modules 12 that achieve a reliable and accurate printing and/or processing methodology. Therefore, in some embodiments, tie bars 14 can be manufactured to a tolerance sufficient to achieve this desired module-to-module spacing. During operation, individual modules 12 of modular ink jet printer system 10 can be removed and replaced to achieve a modified printer operation.

In some embodiments, as illustrated in FIG. 2, each of the plurality of modules 12 can be mounted or other interfaces with base support 16 using standard fasteners 18. In some embodiments, locating pins 20 can be used to locate a module 12 upon base support 16. In this regard, locating pin 20 can extend from either base support 16 or module 12 and be received in a tolerance receiving aperture 22. If modules 12 use flat plate construction, the plates of modules 12 can be constructed using structurally sound flat plate material (usually steel or aluminum) and cross members used to span across the plates. The cross members must be manufactured accurately so that their lengths are consistent in order to achieve parallelism between the plates. The plates are manufactured with the correct holes, slots, cut outs and interfaces for bearings, shafts, motors, rollers and other necessary components.

In some embodiments, it is desirable to position the plurality of modules 12 accurately to base support 16 and to other modules 12 before securing them. To this end, such positioning and/or alignment of modules 12 can be accomplished by machining a receptacle (such as a locating aperture 30 that could include a circular hole, half-hole, or other shape) into the edge of module 12. A corresponding single pin 32 can extend from base support 16 and communicate with locating apertures 30 from multiple modules 12 as illustrated in FIG. 2. Such positioning can be completed prior to fastening of modules 12 to base support 16.

Hurdles overcome within this design include ensuring accurate module placement, designing modules that contain complementary functionality, and standardizing modules 12 so that they can be changed out in the field easily, without re-positioning the remaining modules.

Modular ink jet printer system 10 is being implemented to successfully adjust the digital print equipment to the exact customer needs without having to have multiple single purpose machines. It will also provide for easy field upgrades for customers that find new products to print or require new or additional components.

In some embodiments, a base module or primary module can be used that is larger than other modules of the assembly, as it may contain most critical drive and print functions. The remaining modules or expansion modules can vary in size, depending on the design requirements for that specific module. All modules are designed to place operator functions in an ergonomic zone, limiting the overall height to a practical range.

Electrical, mechanical, piping, pneumatic, other machine utilities and signals are routed to the necessary modules using expandable cabinetry and expandable ducting. Very robust brackets and connecting bars will be utilized to ensure that backplanes of modules 12 being assembled stay truly planar on the base rail system.

What is claimed is:

1. A printer comprising:

a base printing module having;

a base support comprising:

substantially axial member having a plurality of expansion module mounting locations and tolerance receiving apertures, said base support configured for supporting said base module and one or more expansion modules in said expansion module mounting locations via standard fasteners; and a backplane;

a plurality of expansion modules configured with at least one locating pin and configured to be releasably coupled to said base support, wherein each expansion module from said plurality of expansion modules includes a tie bar and a tie bar coupling, wherein each tie bar is configured to couple with a tie bar coupling of an adjacent expansion module, said tie bar comprising a substantially rigid member with a length especially configured for achieving appropriate spacing between said expansion module and said adjacent expansion module;

wherein said base support is further configured with a backplane for ensuring that said base module and said plurality of expansion modules remain planar, and wherein said base support further comprises a tolerance receiving aperture, and wherein each expansion module from said plurality of expansion modules comprises a locating pin, said locating pin being sized to closely conform to said tolerance receiving aperture to achieve a predetermined position of said first expansion module relative to said base support.

2. A reconfigurable printer system comprising:

a base module;

a base support comprising at least one backplane coupled with said base module;

a tie bar system coupled to said base support; and a plurality of expansion modules configured to be releasably coupled to at least one of said tie bar system and said base support system between an operating position and a removed position, said plurality of expansion modules including each of:

a removable unwinder module configured for unwinding substrates;

a removable pre-treatment module configured for pre-treatment;

a removable coater module configured for coating;

a removable curing module configured for curing; and a removable rewinder module configured for rewinding substrates;

wherein said backplane is configured for ensuring that said base module and said expansion module remain planar, and wherein said base support further comprises at least one of a locating pin and a tolerance receiving aperture and said expansion module comprising the other of said locating pin and said tolerance receiving aperture, said locating pin being sized to closely conform to said tolerance receiving aperture to achieve a predetermined position of said expansion module relative to said base support.

3. The printer according to claim 2 wherein said plurality of expansion modules further includes a web cleaner module configured for web cleaning.

4. The printer according to claim 2 wherein said plurality of expansion modules further includes a corona treater module configured for corona treating.

5. The printer according to claim 2 wherein said plurality of expansion modules further includes a static controller module configured for static control.

6. The printer according to claim 2 wherein said plurality of expansion modules further includes a graphic printer module configured for graphic printing.

7. The printer according to claim 2 wherein said plurality of expansion modules further includes an additional curing module configured for additional curing.

8. The printer according to claim 2 wherein said plurality of expansion modules further includes a laminator module configured for laminating.

9. The printer according to claim 2 wherein said plurality of expansion modules further includes a die cutter module configured for die cutting.

10. The printer according to claim 2 wherein said plurality of expansion modules further includes a waste removal module configured for waste removal.

11. The printer according to claim 2 wherein said plurality of expansion modules further includes a number printer module configured for serial number printing.

12. The printer according to claim 2 wherein said plurality of expansion modules further includes a sheeter module configured for sheeting.

* * * * *